US008936157B1

(12) United States Patent
Xu et al.

(10) Patent No.: US 8,936,157 B1
(45) Date of Patent: Jan. 20, 2015

(54) INDEXING MULTI-COMPARTMENT CONTAINER-CAP ASSEMBLY

(71) Applicants: Tao Xu, Naperville, IL (US); Xiaojun Zhang, Shenzhen (CN); Linzhi Fang, Shenzhen (CN)

(72) Inventors: Tao Xu, Naperville, IL (US); Xiaojun Zhang, Shenzhen (CN); Linzhi Fang, Shenzhen (CN)

( * ) Notice: Subject to any disclaimer, the term of this patent is extended or adjusted under 35 U.S.C. 154(b) by 0 days.

(21) Appl. No.: 13/934,518

(22) Filed: Jul. 3, 2013

(51) Int. Cl.
*B65D 83/04* (2006.01)
*A61J 1/03* (2006.01)

(52) U.S. Cl.
CPC ..... *A61J 1/03* (2013.01)
USPC ..... 206/533; 206/534; 220/555; 220/525

(58) Field of Classification Search
CPC ..... A61J 1/03
USPC ..... 206/533, 534, 536, 538, 539, 528; 215/6; 220/553, 527, 525, 555, 523, 220/507, 500; 222/142.9; 221/151, 152, 221/154, 113, 112
See application file for complete search history.

(56) References Cited

U.S. PATENT DOCUMENTS 3,227,127 A * 1/1966 Gayle ..... 116/308
3,561,592 A * 2/1971 McCool ..... 206/534
3,870,192 A * 3/1975 Haley ..... 221/86
3,984,031 A * 10/1976 Thompson ..... 221/82
4,124,143 A * 11/1978 Thomas ..... 221/82
4,253,572 A 3/1981 Halbich
4,473,156 A 9/1984 Martin
4,804,101 A 2/1989 Heath
7,004,324 B1 2/2006 Delorio
7,147,127 B2 * 12/2006 Lepke et al. ..... 221/4
7,624,890 B2 12/2009 Noble et al.
2004/0089581 A1 5/2004 Dienst
2007/0261985 A1 * 11/2007 Allen ..... 206/538

FOREIGN PATENT DOCUMENTS

GB 2215312 A * 9/1989

* cited by examiner

*Primary Examiner* — Mickey Yu
*Assistant Examiner* — Allan Stevens
(74) *Attorney, Agent, or Firm* — Christopher J. Scott

(57) ABSTRACT

An indexing cap assembly indexes visual cues or indicia during an open and close cycle so as to help users more easily track container entry as for example with regard to medications so as to ensure proper dosage. The indexing cap assembly basically incorporates six components, including a cover construction, an indexing plate or wheel, a compression coil or spring, a push plate construction, a gear tray or swing plate construction, and an assembly ring. The cover construction and assembly ring are joined together to essentially form or close the cap assembly with the other parts coaxially aligned and operable therebetween. The indexing wheel is rotatively received within the cover construction such that axial displacements of the push plate advance the indexing wheel and indicia upon its upper surface are sequentially revealed by way of the window formed in the cover construction.

18 Claims, 6 Drawing Sheets

INDEXING MULTI-COMPARTMENT CONTAINER-CAP ASSEMBLY

BACKGROUND OF THE INVENTION

1. Field of the Invention

The present invention relates generally to a combination container-cap construction for enabling users to gain access to separately housed container contents within a single container-cap construction. More particularly, the present invention relates to a multi-compartment container-cap assembly for enabling users to sequentially gain access to successive compartments, which sequential and successive access may be cyclically indexed.

2. Brief Description of the Prior Art

U.S. Pat. No. 4,253,572 ('572 patent), issued to Halbich, discloses a Plastic Pillbox. The '572 patent describes a dispensing container or box for pills or capsules having multiple individual compartments, which can be individually opened for extracting or dispensing a pill or capsule. The individual compartments are formed by partitions within the container. A top or cover is provided which is initially integral and which provides a plurality of tabs arranged so that an individual tab covers each compartment, the tabs being attached to the cover by a frangible part that can be manually broken free. Each tab is provided with means in the form of a depending rib shaped to snugly fit into the top of its respective compartment to provide an air tight fit. Latching detent means are provided as between the integral cover and the container so that when the cover is positioned it cannot be taken off or removed from the container.

U.S. Pat. No. 4,473,156 ('156 patent), issued to Martin, discloses a Method and apparatus for accurately selecting storing and dispensing pills. The '156 patent describes an apparatus for accurately selecting, storing and dispensing multiple varieties of pills at preselected time intervals such as morning, noon, evening and night includes a separate pill container for each unique variety of pill to be dispensed.

Each pill container is identified by a distinctive color or colors to indicate the time interval(s) during which the pill in it is to be dispensed. For example, each container for pills to be dispensed in the morning will be identified at least by the color red; at noon, at least yellow; in the evening, at least blue; and at night at least black. Any particular container will, therefore, be identified by at least one and not more than four colors.

A pill tray includes a plurality of pill holding compartments arranged in columns identified with each of the days of the week and in row, each row representing one of the time intervals, such as morning, noon, evening and night. Each pill holding compartment in the row representing morning is colored red, the row representing noon is colored yellow, the evening row is colored blue, and the night row is colored black.

The tray is loaded by putting one pill from each container in each of the compartments colored the same as one of the colors identifying that container. Sliding panels are provided as covers for each of the columns, and the patient can access the proper medication by uncovering the appropriate compartment at the appropriate time interval. For example, on Monday morning, the patient slides the "Monday" panel down far enough to uncover the Monday morning compartment, removes the pills and ingests them.

U.S. Pat. No. 4,804,101 ('101 patent), issued to Heath, discloses a Container assembly including lower compartment comprising chordal partitions. The '101 patent describes a container assembly for containing a commodity in a cylindrical primary container, and further including a cylindrical base and dispenser subassembly for receiving the cylindrical container, and for dispensing elongated, thin articles. The base and dispenser subassembly includes an upwardly extending peripheral flange, a downwardly extending peripheral flange and a transverse partition therebetween carrying the flanges.

Parallel chordal partitions extend across, and substantially normal to, the transverse partition, and define a multiple article storage compartment. A dispenser closure cap includes an end plate which extends across the top of the article storage compartment. The end plate carries an annular outer flange which rotatably engages the downwardly extending peripheral flange. A mirror is affixed to the exterior of the end plate. In another form, the primary container may simply be formed as an integral part of the base and dispenser subassembly.

U.S. Pat. No. 7,004,324 ('324 patent), issued to Delorio, discloses a Multi-compartment pill container. The '324 patent describes a multi-compartment pill container constructed to hold a week's worth of medication for a user. The container has a housing having a top surface, a number of removable compartments held within the rectangular openings in the top surface of the housing, and a lid attached to the housing and extending over the compartments.

Each compartment is divided into chambers by separation walls. Each chamber has a chamber cover on which indicia is printed. The indicia include abbreviations for the days of the week for each of the compartments, as well as times of the day for each of the chambers. At the correct time, the user ingests the medication from the appropriate chamber. The container also includes a telescopic drinking cup to aid in the taking of medication and a timer to notify the user to take the medication. Each compartment may be completely removed from the housing to allow the user to carry the compartment separate from the entire container.

U.S. Pat. No. 7,624,890 ('890 patent), issued to Noble et al., discloses a Multiple Compartment Container. The '890 patent describes a lid arrangement for a container with a hinged mating lid. The disclosed lid arrangement avoids inadvertently opening the lid, while at the same time allows easy opening when opening the lid is desired. The lid arrangement is configured to be used with a wide variety of different types of containers with hinged lids. In some embodiments, the lid arrangement is incorporated into a multiple compartment pill container.

United States Patent Application Publication No. 20040089581, authored by Dienst, discloses a Pill Holder. The Dienst publication describes a pill container for holding pills, other medication, caplets, vitamins or nutritional supplements. The container may be comprised of a container with multiple closable compartments. Each compartment can be closed with a lid that is hingeably attached to the compartment. In one aspect of the device, the lid has a fastener that engages with a nub on the compartment.

The compartments of the container are designed with a deformable surface that releases the nub from the fastener to spring open the lid. In another aspect of the invention, the container has legs that provide it stability to rest on a flat surface. In another aspect of the invention, the bottom surface of the container's compartments is bowl-shaped to allow the items stored within to be easily scooped out.

United States Patent Application Publication No. 2010294739, authored by Morris et al., describes a multi-compartment container cap comprising a hollow tubular body having a dividing wall forming a proximal compartment located at a proximal end of the hollow tubular body and a distal compartment located at the distal end of the hollow tubular body. The proximal end of the hollow tubular body is adapted to be releasably attached to a container body while the distal compartment comprises a separate compartment for the storage and dispensing of a composition which can be selected to be complementary to any composition store within the container cap.

As may be understood from a consideration of the foregoing, the prior art has shown a number of multi-compartment container-cap assemblies for providing users thereof with certain means to carry multiple types of container contents (e.g. pills) stored in varied compartments and enabling the user to access the compartments for obtaining the container contents in an organized manner so that the contents (e.g. pills) may be obtained according to prescribed scheduling. It will be further understood, however, from a review of the foregoing, and the field of multi-compartment containers and the like, that the prior art perceives a need for multi-compartment container-cap assembly substantially as summarized hereinafter.

SUMMARY OF THE INVENTION

A primary objective of the present invention is to provide a multi-compartment container-cap assembly that allows the user to store and carry multiple types of container contents as exemplified by medicine pills and indexes a visual cue during a rotated cycle.

To accomplish this primary objective, the present invention generally provides a pill dispenser type container-cap assembly having multiple compartments. Each compartment may thus store different kinds of contents, as exemplified by various kinds of pills for daily consumption. A non-removable cover or cap assembly may be rotated to reveal or expose a single opening for each compartment and enable the user to gain access to the contents or pills one compartment at a time.

An indexing window incorporated into the cover or cap assembly further provides a visual cue to the user of the advancement of the cycle as may be exemplified by a day (Monday to Sunday) when the cover or cap assembly is rotated a complete circle. The cover or cap assembly according to the present invention may be rotated by pushing a button on the side of the cover, and can be rotated in only one rotational direction. The contents or pill compartments can be accessed or opened one at a time when the cover makes its predetermined stop with the help of engagement of the push button and the holes on the side of the cover.

More specifically, the container portion of the container-cap assembly according to the present invention has a number of compartments for different contents. The drawings in support of these specifications show a container-cap assembly having four contents-holding compartments. The cover or cap assembly of the container-cap assembly has a window that provides a visual cue such as day (Monday through Sunday) information and an opening for outletting the container contents.

The cap can rotate on the top of the bottle and can be stopped at equi-spaced positions, as exemplified by five equi-spaced positions in the drawings. The opening of the cap is blocked at one position of the five positions, and at the other four positions, the opening of the cap is open for outletting container contents from the four contents-holding compartments.

With every circle or cycle of cap rotation, the index (e.g. day information) will be advanced once. This container and cap combination may thus benefit patients insofar as it provides a device that enables the user to take different medicines with a single container. Another benefit of the invention is to enable seniors or old patients to know if they have taken the medicine or not for the day. Further, the gearing and the index can be adjusted to make the invention suited for several cycles per day. For example, oftentimes patients are required to take one or more medicines several times per day.

Accordingly, the primary object of this invention is to provide a medicine container that can contain different medicines and can visually alert the senior or older patient if they have taken the pills for the day on any given day. The patient may turn the cap; and it will stop at different positions to obtain different medicines.

Each time the patient finishes obtaining all the medicines during a complete cycle, the cap completes a total rotative cycle or circle, and the visually displayed day information will be updated to the next day per cycle. Other objectives and details of the subject invention will be readily apparent from a consideration of the drawings and specifications in support of this application. Brief descriptions of the drawings are provided hereinafter.

BRIEF DESCRIPTION OF THE DRAWINGS

Other features of our invention will become more evident from a consideration of the following brief descriptions of illustrations of the subject invention.

DETAILED DESCRIPTION OF THE PREFERRED EMBODIMENT

Figure 1:
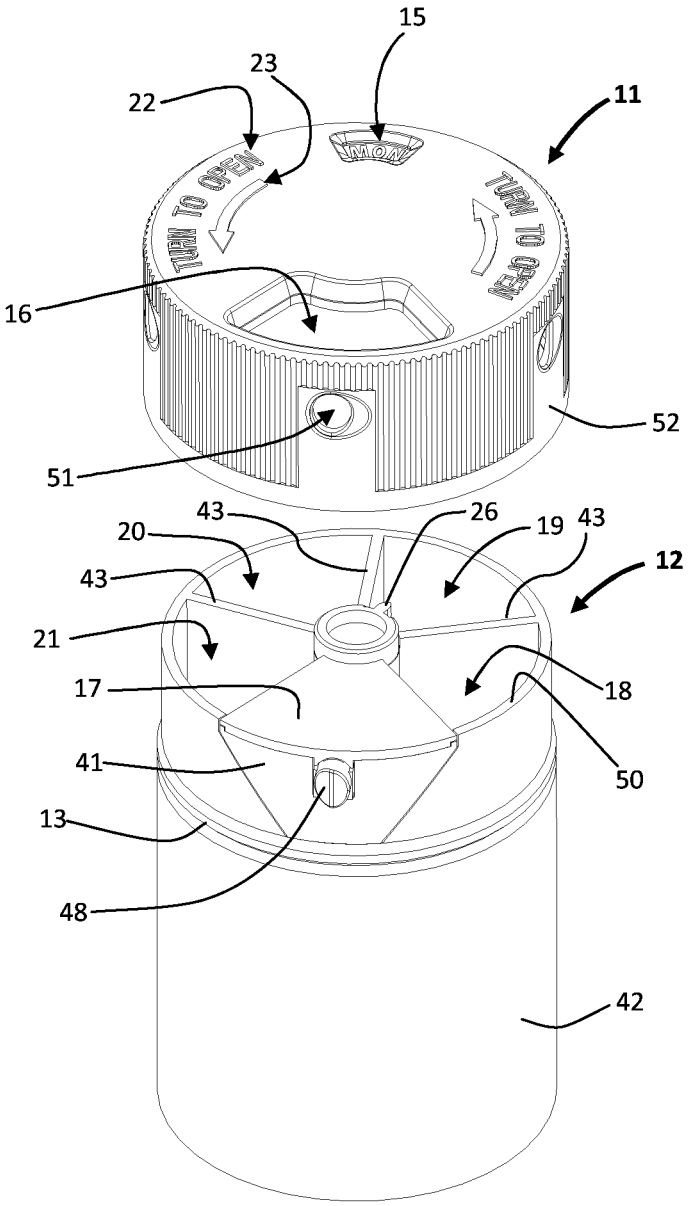
FIG. 1 is an exploded top perspective view of the multi-compartment container-cap assembly according to the present invention showing the upper cap assembly exploded from the lower container assembly.
Figure 2:
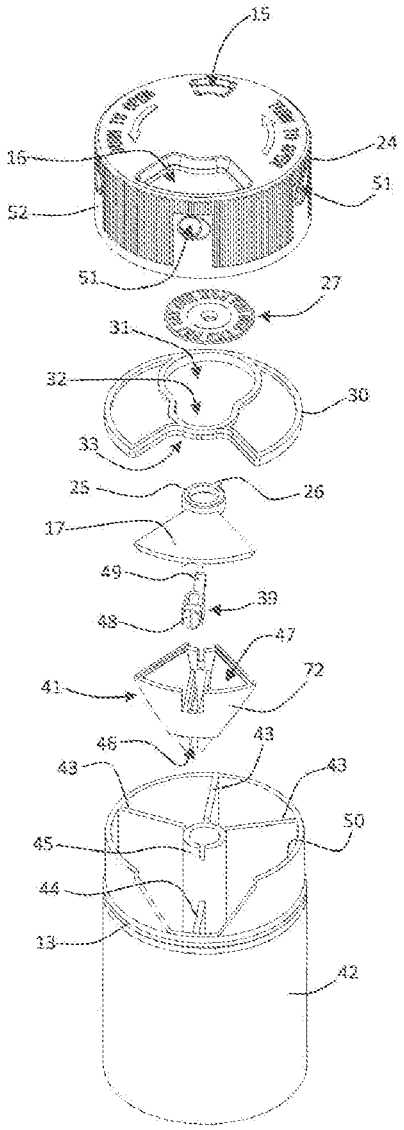
FIG. 2 is an exploded top perspective view of the multi-compartment container-cap assembly according to the present invention showing all elements of container-cap assembly in exploded relation relative to one another.

Referring now to the drawings with more specificity, FIG. 1 depicts an exploded view of the multi-compartment container system or container-cap assembly 10 according to the present invention showing an upper cap assembly 11 in exploded relation relative to a lower bottle or container assembly 12. The cap assembly 11 is to be pressed onto the bottle or container assembly 12 such that a groove 13 of the container assembly 12 will permanently mesh or cooperate with a hook or ridge 14 of the cap assembly 11 to effect free rotation by way of the ridge 14 and groove 13 after assembly. A more detailed exploded top perspective view of all components is comparatively shown in FIG. 2.

Figure 3:
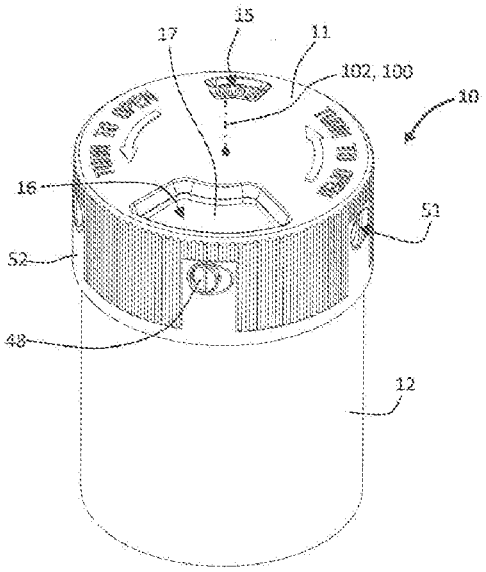
FIG. 3 is a top perspective view of the multi-compartment container-cap assembly according to the present invention showing the assembled container-cap assembly in a closed configuration.

FIG. 3 depicts the container system 10 in a rotatably closed configuration whereby the bottle or container assembly 12 and cap assembly 11 are rotatably assembled and the cap assembly 11 comprises both an indexing window 15 and a contents-letting opening or aperture 16 for enable the user to access container contents. The opening or aperture 16 of the cap assembly 11 is blocked by a top surface of block plate 17 made part of the container assembly 12.

Figure 4:
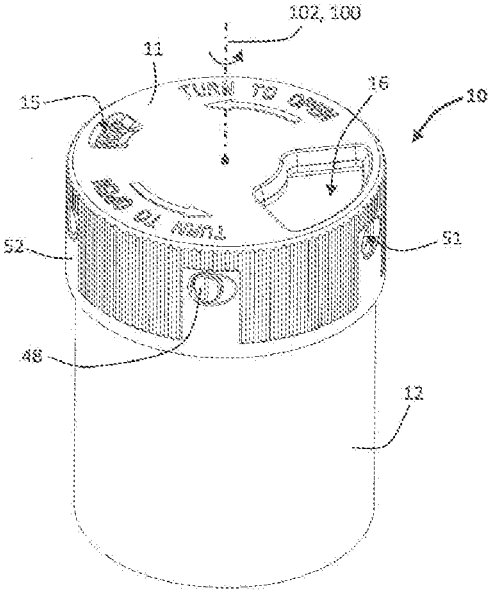
FIG. 4 is a top perspective view of the multi-compartment container-cap assembly according to the present invention showing the assembled container-cap assembly in a first of four possible open configurations.

In contrast to FIG. 3, FIG. 4 comparatively depicts a first of four possible open configurations for the container system or container-cap assembly 10. In other words, FIG. 4 shows one of the open configurations of the assembled container assembly 12 and cap assembly 11. The opening or aperture 16 of the cap assembly 11 is rotatably re-positioned from the position shown in FIG. 3 (i.e. over the top surface structure 17) to be over the top of a sequentially first cavity or first compartment as at 18 of the container assembly 12. A second compartment is depicted and referenced at 19; a third compartment is depicted and referenced at 20; and a fourth compartment is depicted and referenced at 21. Container contents such as medicines in pill form may be contained in these cavities or compartments 18-21, and the user or patient is able to obtain or access the container contents such as medicines or pills through the opening 16.

Figure 5:
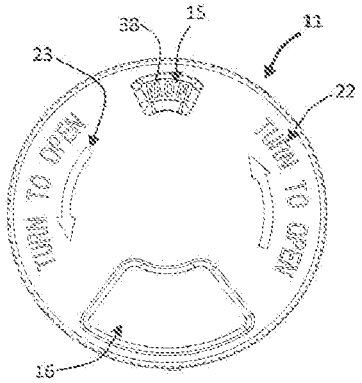
FIG. 5 is a top plan view of the cap assembly portion of the multi-compartment container-cap assembly according to the present invention.

FIG. 5 depicts a top plan view of the cap assembly 11 of the (medicine) container system or container-cap assembly 10 according to the present invention. Users or patients can see the index (e.g. day information) through the indexing window 15 formed in the cap assembly 11. Two concentric circular sets of indicia (e.g. textual directive(s) as at 22 and arrows as at 23) are preferably placed on the top of the cover or cap housing 24 provide the user or patient with operation instructions.

Figure 6:
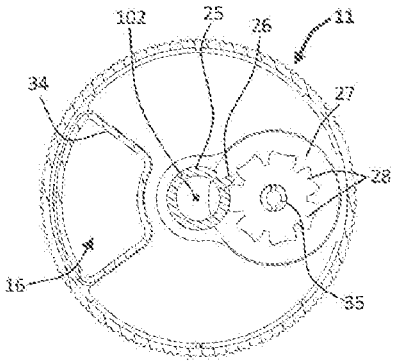
FIG. 6 is a bottom sectional view of the cap assembly portion of the multi-compartment container-cap assembly according to the present invention showing certain gearing means associated with the cap assembly.

FIG. 6 more particularly shows a transverse sectional view through a hub-topping gear structure 25 (having a single projecting gear tooth as at 26) of the block plate 17 for the purpose of illustrating gearing associated with the cap assembly 11. This view perhaps best shows the mechanism or means employed by the container-cap assembly 10 to update the index information (e.g. day information) viewable by the user through the indexing window 15. The gear tooth 26 cooperates or meshes with the indexing wheel 27, which indexing wheel 27 comprises gears 28 on its underside 29, and fits within a wheel-receiving aperture 31 formed in the padding plate 30.

The padding plate 30 further comprises a gear structure-receiving portion as at 32 for accommodatingly receiving the hub-topping gear structure 25; and an aperture-cooperative cutout as at 33 sized and shaped to essentially accommodate the size and shape of the contents-letting opening or aperture 16. In this regard, it will be seen that the contents-letting opening or aperture 16 comprises a peripheral ridge as at 34. The cutout 33 aligns itself adjacent the ridge 34 when assembled in positioned placement within the cap housing 24.

The indexing wheel 27 is rotatably attached to the cap housing 24 via a hub formation or flanged post as at 35 and post-receiving aperture 36 formed in the indexing wheel 27. The upper surface 37 of the indexing wheel 27 preferably comprises indexing information 38 such as textual information to provide visual indexing information such as day information to the user or patient via the indexing window 15 formed in the cap housing 24. From a comparative inspection of FIGS. 5-9, the reader will more fully understand how the gearage of the cap assembly 11 assembles and operates.

Figure 7:
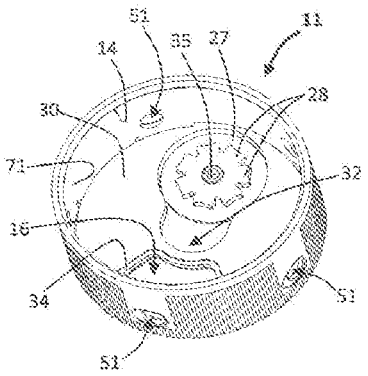
FIG. 7 is a bottom perspective view of the assembled cap assembly portion of the multi-compartment container-cap assembly according to the present invention.

Referencing FIG. 7, the reader will consider a view of the cap assembly 11 from the bottom perspective. The hook 14 on the inner wall of cover housing 24 will mesh with groove 13 formed on the container assembly 12 as further depicted and referenced in FIGS. 1, 2, and 11. Referencing FIG. 8, the reader will consider an exploded bottom perspective view of the cap assembly 11. This view attempts to show in greater clarity the method for assembling the indexing wheel 27, the padding plate 30, and cover housing 24.

Figure 9:
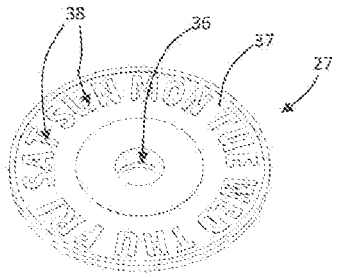
FIG. 9 is a top perspective view of the indexing wheel element of the cap assembly of the multi-compartment container-cap assembly according to the present invention.
Figure 10:
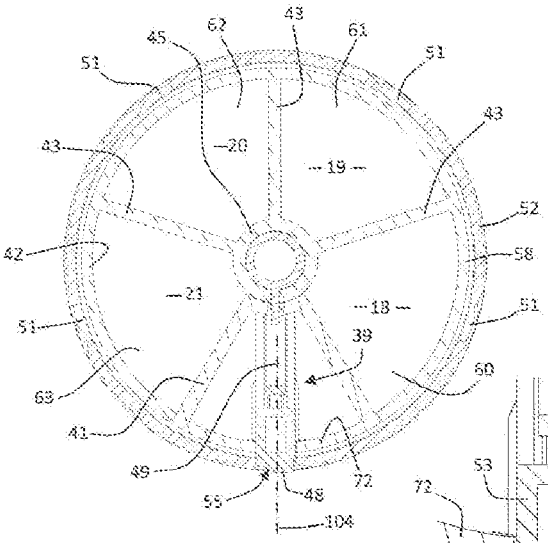
FIG. 10 is a transverse cross-sectional view through the button element of the upper cap assembly as assembled upon the lower container assembly of the multi-compartment container-cap assembly according to the present invention.
Figure 11:
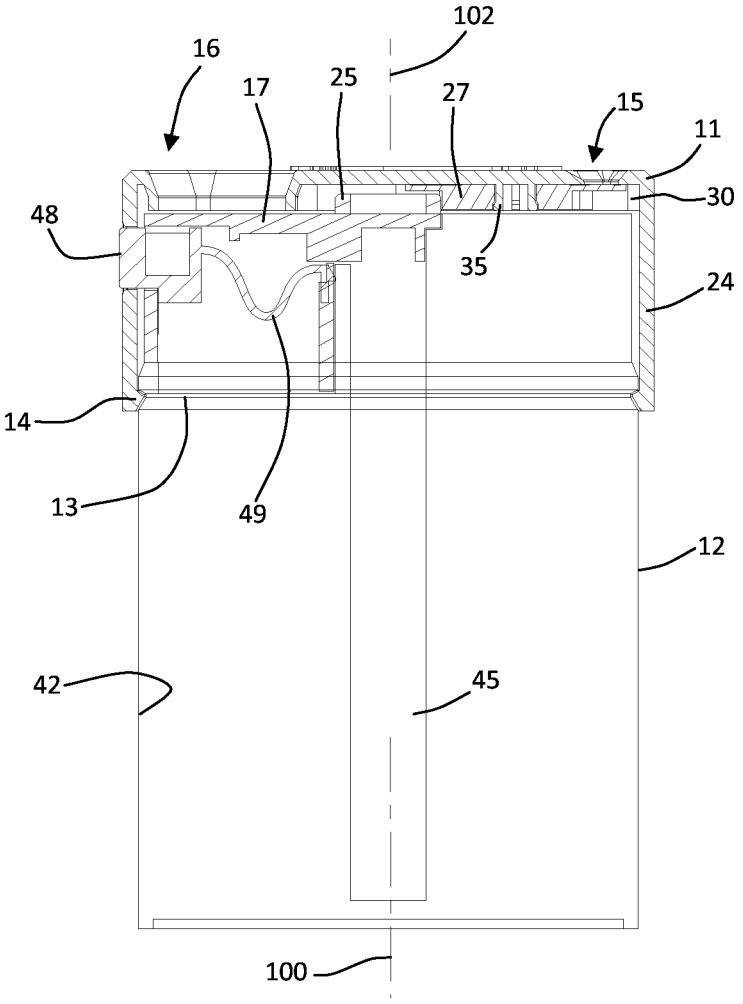
FIG. 11 is a longitudinal cross-sectional view through the button element of the upper cap assembly as assembled upon the lower container assembly of the multi-compartment container-cap assembly according to the present invention.

FIG. 9 depicts a top perspective view of the indexing wheel 27 clearly showing the upper surface 37 with indexing information 38, and the post-receiving aperture 36. The indexing information 38 as exemplified by day (Monday through Sunday) information is preferably equi-spaced and provided upon the upper surface 37. FIG. 10 shows a transverse sectional view through the button mechanism 39 of the container assembly 12 as assembled to the cap assembly 11; and FIG. 11 shows a longitudinal cross-sectional view of the assembled container assembly 12 and cap assembly 11 as further sectioned through the button mechanism 39 of the container assembly 12. This view attempts to clearly depict the structural form and function of the button mechanism 39 and surrounding support structures.

Figure 8:
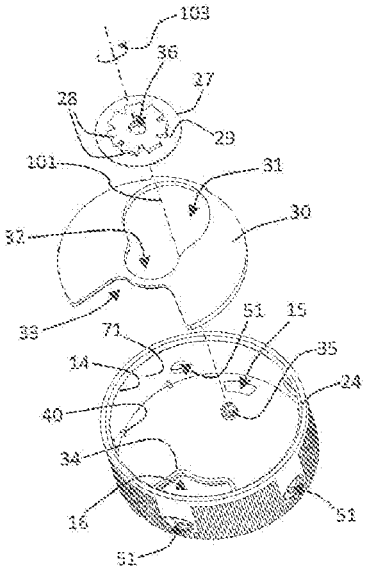
FIG. 8 is an exploded bottom perspective view of the cap assembly portion of the multi-compartment container-cap assembly according to the present invention.

Comparatively referencing FIGS. 7-9, the reader will see that the cap assembly 11 preferably comprises three primary parts, namely, the cover housing 24, the indexing wheel 27, and the padding plate 30. The upper surface 37 of the indexing wheel 27 has a ring of indexing information as at 38, which indexing information 38 may preferably display information such as the day of a week. The bottom or underside 29 of the indexing wheel 27 has a ring of special gears 28, which in this example preferably number 7 to match the days of the week.

The indexing wheel 27 has a post-receiving aperture as 36 in the center of the indexing wheel 27. The indexing wheel 27 is to be held by the hub formation or flanged post 35 on the cover housing 24 through the post-receiving aperture 36. The indexing wheel 27 can thus rotate freely after assembly. The padding plate 30 is held by a group of posts 40 formed on the inner wall 71 of the cover housing 24 by way of press-fitting.

The container assembly 12 preferably comprises four primary parts, namely, the block plate 17, the button mechanism 39, a divider mechanism as at 41, and a container body as at 42. As depicted and referenced in FIGS. 1, 2, and 10, the container body 42 as exemplified in the drawings and specifications, preferably comprises four compartment-dividing inner walls that radiate outwardly from a central container hub 45. Three of the inner walls as at 43 extend the full length of the container body 42, and one of the inner walls as at 44 extends a partial length of the container body 42 (to accommodate the divider mechanism 41) thereby forming four container cavities or compartments as earlier referenced at 18-21.

The four cavities or compartments 18-21 can contain four different kinds of content such as medicines.

The divider mechanism 41 assembles onto the inner wall 44 of the container body 42. In this regard, the inner wall 44 is inserted into a groove 46 of the divider mechanism 41. The block plate 17 is inserted on the top of the container body 42 and covers the otherwise open top of the divider mechanism 41. Received within a cavity 47 defined by the divider mechanism 41, the button mechanism 39 is preferably spring-biased and thus preferably comprises a button as at 48, and a spring element as at 49, which spring element 49 comprises a resilient material and thus forms spring-biasing means.

The button mechanism 39 is preferably fixed into the chamber or cavity as at 47 which cavity 47 is enclosed by the divider mechanism 41 and the block plate 17. The block plate 17 covers the cavity 47 defined by the divider mechanism 41, in which is received the button mechanism 39. The divider mechanism 41 groove-receives the upper end of the inner wall 44 via its groove 46 and thus rests thereupon such that the top surface of the block plate 17 is coplanar with the upper edging of the outer container wall 50 of the container body 42.

The cover housing 24 preferably comprises five circumferentially equi-spaced button-receiving holes or apertures as at 51 formed in the side wall 52 of the cover housing 24 (for the exemplified four-compartment embodiment described and illustrated in these specifications). After the cap assembly 11 and the container assembly 12 are assembled, the button 48 of the button mechanism 39 extends through a select aperture 51. In order to operate the container-cap assembly 10, the user or patient must first depress the button 48 via the spring element 49 and turn or rotate the cap assembly 11 as the arrow at 23 directs.

For every button depression and attendant partial cap turn, the cap assembly 11 advances one step, or in the case of the illustrated embodiment, one fifth of a cycle or circle (i.e. 72 rotational degrees) to access each successive compartment 18-21. The user or patient may thus sequentially access each of the compartments 18-21. Once the user or patient has accessed each of the compartments 18-21, the contents-letting opening or aperture 16 of the cap assembly 11 is blocked by the block plate 17, which blockage effectively closes the system or container-cap assembly 10, and provides feedback to the user or patient that they have accessed each compartment and thus retrieved their proper cyclic dosage.

As comparatively depicted in FIGS. 10 and 11, the button mechanism 39 effectively prevents the cap assembly 11 from rotation when the button 48 is coaxially aligned with, and extends through a select aperture 51. The reader should note from an inspection of FIG. 10(A) that the button 48 and aperture(s) 51 are particularly configured so that the button lock mechanism is operative from opposed lateral sides of the button 48. To one side, the button wall as at 53 engages hole wall 56 (of a select aperture 51) to a first side of cover housing 24, and on the other side, the button wall 54 engages the opposing hole wall 57 (of the select aperture 51) of cover housing 24.

The button wall 53 is shorter than the button wall 54 and forms a bezel as at 55. A user or patient is unable to turn or rotate the cap assembly 11 without depressing the button 48 of the button mechanism 39, which button mechanism 39 (comprising button 48 and spring element 49) is received within the divider mechanism 41 and extends radially along plane 104 extending outwardly from the central container hub 45 and through an outer wall 72 of the divider mechanism 41. Once the button 48 is depressed, the button wall 53 is displaced radially inward relative to the cap assembly 11.

Figure 10A:
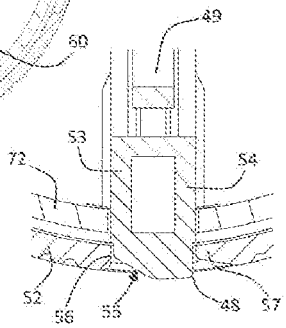
FIG. 10A is an enlarged fragmentary view of the button element otherwise depicted in FIG. 10, enlarged to show in greater clarity the button element and surrounding support structures.

As the user or patient continues to rotate the cap assembly 11, the bezel 55 meshes with the hole wall 56 in the direction of rotation (i.e. left side wall 56 of the hole 51 in FIG. 10) and the button 48 is directed radially inward by engaging the hole wall 56 with the bezel structure 55 under the forces from rotation. The button 48 returns to its relaxed, hole-penetrating position as shown in FIGS. 10 and 10A under restorative spring forces of spring element 49 when encountering a successive aperture 51, thereby preventing the cap assembly 11 from further rotation.

FIG. 6 depicts the mechanism or means to advance the indexing wheel 27 for displaying indexing information such as day information to the user/patient. Block plate 17 has one gear tooth 26 on the top side. After the cap assembly 11 is assembled to the container assembly 12, the gear tooth 26 meshes with the gears 28 of the indexing wheel 27 (seven gears 27 are depicted for this example in accordance or keeping with the seven days of the week). Block plate 17 with a single gear tooth 26 fixes at the center axis 100 of the container body 42. Note that the cap axis 102 is coaxially aligned with container axis 100 when the cap assembly 11 is rotatably fastened to the container assembly 12).

When the user or patient depresses the button 48 radially inward, and rotates the cap assembly 11 to access the compartments 18-21 for the purpose of obtaining the container contents (i.e. medicines), the indexing wheel 27 with gears 28 is held by cover housing 24 and rotates about axis 101 as at arrow 103 in FIG. 8. The gear ratio between single gear tooth 26 and gears 28 in the illustrated example is 1:7. Each time the indexing wheel 27 with gears 28 rotates around the single gear tooth 26 in a completed circle or cycle, the indexing wheel 27 with gears 28 rotates 1/7 circle.

The pitch diameter of single gear tooth 26 and gears 28 is especially designed to make single gear tooth 26 drive gears 28 only at the last 1/5 of a circle/cycle. To be more exact, the indexing wheel 27 with indexing information as at 38, does not rotate about its own axis at the beginning 4/5 of a circle/cycle when rotating the cap assembly 11. Rather, at the last 1/5 circle/cycle, the indexing wheel 27 will rotate 1/7 of a circle/cycle (in this example) about its own axis as at 101.

In other words, during a complete cycle of access to the compartments 18-21, the indexing information as exemplified by day information in these specifications made visible through the window 15 does not change when the user or patient accesses each of the successive compartments 18, 19, 20, and 21 for the purpose of obtaining container contents or medicines therefrom. The indexing information, rather, is advanced to the subsequent visual cue (e.g. the next day) when the user or patient closes the system after obtaining a medicine from each of the compartments 18-21.

While the foregoing specifications set forth much specificity, the same should not be construed as setting forth limits to the invention but rather as setting forth certain preferred embodiments and features. For example, it is contemplated that the foregoing specifications support or teach a multi-compartment, container-cap assembly, which the multi-compartment, container-cap assembly essentially comprises a container assembly as at 12, and a cap assembly as at 11.

The container assembly according to the present invention is believed to essentially comprise a container body as at 42, and a divider assembly which divider assembly may be said to preferably include the divider mechanism 41, the button mechanism 39, and the block plate construction 17. The container body 42 preferably comprises an outer container wall as at 58, a series of inner container walls as at 43 and 44, and a container body axis as at 100. The series of inner container walls 43 and 44 form a series of matter-containing compartments as at 18-21 within the container body 42. The divider assembly is received at an upper end of the container body 42 and assembled thereto.

The cap assembly 11 is believed to essentially comprise a contents-letting aperture as at 16 and a cap axis as at 102. The cap assembly 11 is rotatably fastened to the container assembly 12 such that the container body and cap axes 100 and 102 are coaxial. The contents-letting aperture 16 may be blocked by the divider assembly in a closed cap-to-container rotatable position as generally depicted in FIG. 3. Further, the cap assembly 11 may be selectively rotated about the cap axis 102 or re-positioning the contents-letting aperture 16 in superior adjacency to the matter-containing compartments 18-21 through a series of open cap-to-container rotatable positions, a first of which is generally depicted in FIG. 4.

The multi-compartment container-cap assembly according to the present invention may further preferably comprise certain indexing information provision means for providing a user with indexing information regarding rotational use or position of the cap assembly 11 relative to the container assembly 12 (e.g. day or cycle information). The indexing information provision means may be exemplified by the indexing wheel 27 in cooperative association with the indexing window 15. The indexing wheel 27 is made selectively rotatable under rotatable action of the cap assembly 11 relative to the container assembly 12 for providing updated indexing information to a user via the indexing window 15.

The indexing wheel 27 and a portion of the divider assembly as exemplified by the gear tooth 26 of the block plate 17 may preferably comprise cooperable gearing (i.e. the gear tooth 26 and the gears 28). The cooperable gearing essentially function to advance the indexing wheel 27 a select rotational degree during a complete rotational cycle of the cap assembly 11 relative to the container assembly 12.

The multi-compartment container-cap assembly according to the present invention may further comprise certain button-based cap-advancing means for enhancing selectively positioned placement of the contents-letting aperture 16 in superior adjacency to the matter-containing compartments 18-21. The button-based cap-advancing means may be exemplified by the cooperative association of the button mechanism 39 of the divider assembly, and the button-receiving apertures incorporated into the cap assembly 11.

The multi-compartment container-cap assembly according to the present invention may further preferably comprise inner container walls that are spaced from one another such that each matter-containing compartment is transversely sector shaped as perhaps is most clearly depicted in FIG. 10. Noting that a geometrical sector or sector shape of any circular structure may be defined as a geometric figure bounded by two radii and the included arc of a circle, the sector shape of each matter-containing compartment may be preferably defined by that space or shape transversely bound by the central container hub 45, the inner walls 43 extending radially from the central container hub 45, and the arc length of the circular outer container wall 50 for a given matter-containing compartment.

A top surface of the divider assembly (or a top surface of block plate 17) effectively masks an adjacent portion of both a sequentially first sector as at 60, a second sector as at 61, a third sector as at 62, and a fourth or sequentially last sector as at 63 of the transversely sector shaped matter-containing compartments 18, 19, 20, and 21 (sectors 60, 61, 62, and 63 correspond respectively to compartments 18, 19, 20, and 21) immediately adjacent to the divider assembly for visually sizing and shaping the first and last sector 60 and 63 to effectively match the size and shape of select other sectors as may be exemplified by sectors 61 and 62.

Accordingly, although the invention has been described by reference to certain preferred and exemplary embodiments, it is not intended that the novel arrangements be limited thereby, but that modifications thereof are intended to be included as falling within the broad scope and spirit of the foregoing disclosures and the appended drawings.

We claim:

1. A multi-compartment container-cap assembly for enabling sequential access to successive matter-containing compartments, the multi-compartment container-cap assembly comprising:

a cylindrical container assembly, the cylindrical container assembly comprising a container body, a divider mechanism, a button mechanism, and a block plate, the container body comprising a container height, a container diameter, a container bottom, an outer container wall, a container hub, an abbreviated inner container wall, a series of full length inner container walls, and a container body axis, the abbreviated inner container wall being abbreviated in length relative to the full length inner container walls, the abbreviated and full length inner container walls radiating outwardly from and connecting the container hub to the outer container wall thereby forming a series of matter-containing compartments, the divider mechanism being seated upon the abbreviated inner container wall, the button mechanism being received within the divider mechanism and extending radially outwardly from the container hub and extending through an outer wall of the divider mechanism, the block plate enclosing the button mechanism within the divider mechanism and having a first sector size and a first sector shape; and a cylindrical cap assembly, the cylindrical cap assembly comprising a cap housing, a padding plate, and a cap assembly axis, the cap housing comprising a contents-letting aperture, the padding plate being received in and fastened to the cap housing and comprising an aperture-cooperative cutout, the contents-letting aperture and the aperture-cooperative cutout being aligned and each having a substantially similar second sector size and a second sector shape, the first and second sector shapes being substantially similar, the first sector size being greater than the second sector sizes, the cap assembly being rotatably fastened to the container assembly such that the container body and cap assembly axes are coaxial, the second sector sizes and second sector shapes of the aligned contents-letting aperture and aperture-cooperative cutout being blocked by the first sector size and the first sector shape of the block plate in a closed cap-to-container rotatable position, the cap assembly being selectively rotatable about the cap assembly axis via the button mechanism for re-positioning the contents-letting aperture in superior adjacency to the matter-containing compartments through a sequential series of open cap-to-container rotatable positions for enabling the user to sequentially gain access to the matter-containing compartments.

2. The multi-compartment container-cap assembly of claim 1 wherein the cap assembly comprises indexing information provision means, the indexing information provision means for providing a user with indexing information regarding rotational use of the cap assembly relative to the container assembly.

3. The multi-compartment container-cap assembly of claim 2 wherein the indexing information provision means comprise an indexing wheel, the cap assembly comprises an indexing window, and the padding plate comprises a wheel-receiving aperture, the indexing wheel being rotatably received in the wheel-receiving aperture and made selectively rotatable under rotatable action of the cap assembly relative to the container assembly for providing updated indexing information to a user via the indexing window.

4. The multi-compartment container-cap assembly of claim 3 wherein the indexing wheel comprises gears and the block plate comprises a gear tooth, the gear tooth being meshed with the gears for advancing the indexing wheel a select rotational degree during a complete rotational cycle of the cap assembly relative to the container assembly.

5. The multi-compartment container-cap assembly of claim 1 wherein the cap assembly comprises a cap wall, the cap wall comprising a series of button-receiving apertures, the button-receiving apertures for receiving a radially extending button of the button mechanism, the button and button-receiving apertures for enhancing sequential positioned placement of the contents-letting aperture in superior adjacency to the matter-containing compartments.

6. The multi-compartment container-cap assembly of claim 1 wherein the container body comprises a circumferential groove and the cap assembly comprises a circumferential ridge, the circumferential groove receiving the circumferential ridge when the cap assembly is rotatably fastened to the container assembly, the circumferential groove and ridge being cooperable for enabling a user to rotate the cap assembly relative to the container assembly.

7. The multi-compartment container-cap assembly of claim 1 wherein the inner container walls are radially spaced from one another such that each matter-containing compartment is transversely sector shaped, the first sector size and first sector shape of the block plate being substantially equal to select sectors of the transversely sector shaped matter-containing compartments, the block plate masking an adjacent portion of both a first and a last sector of the transversely sector shaped matter-containing compartments adjacent to the block plate for visually sizing and shaping the first and last sector to effectively match the size and shape of the select sectors.

8. A multi-compartment container-cap assembly for enabling sequential access to successive matter-containing compartments, the multi-compartment container-cap assembly comprising:

a container assembly, the container assembly comprising a container body, and a divider assembly, the container body comprising an outer container wall, a container hub, a series of inner container walls, and a container body axis, a select first inner container wall being abbreviated in height relative to select other inner container walls, the select first and select other inner container walls radiating outwardly from and connecting the container hub to the outer container wall thereby forming a series of matter-containing compartments, the divider assembly being received in superior adjacency to the select first inner container wall and assembled to the container body; and a cap assembly, the cap assembly comprising a contents-letting aperture and a cap axis, the cap assembly being rotatably fastened to the container assembly such that the container body and cap axes are coaxial, the contents-letting aperture being blocked by the divider assembly in a closed cap-to-container rotatable position, the cap assembly being selectively rotatable about the cap axis for re-positioning the contents-letting aperture in superior adjacency to the matter-containing compartments through a sequential series of open cap-to-container rotatable positions for enabling the user to sequentially gain access to the matter-containing compartments.

9. The multi-compartment container-cap assembly of claim 8 wherein the cap assembly comprises indexing information provision means, the indexing information provision means for providing a user with indexing information regarding rotational use of the cap assembly relative to the container assembly.

10. The multi-compartment container-cap assembly of claim 9 wherein the indexing information provision means comprise an indexing wheel and the cap assembly comprises an indexing window, the indexing wheel being made selectively rotatable under rotatable action of the cap assembly relative to the container assembly for providing updated indexing information to a user via the indexing window.

11. The multi-compartment container-cap assembly of claim 10 wherein the indexing wheel comprises gears and the divider assembly comprises a gear tooth, the gear tooth being meshed with the gears for advancing the indexing wheel a select rotational degree during a complete rotational cycle of the cap assembly relative to the container assembly.

12. The multi-compartment container-cap assembly of claim 8 wherein the cap assembly comprises a series of button-receiving apertures and the divider assembly comprises a button mechanism, the button-receiving apertures for receiving a radially extending button of the button mechanism, the button and button-receiving apertures for enhancing sequential positioned placement of the contents-letting aperture in superior adjacency to the matter-containing compartments.

13. The multi-compartment container-cap assembly of claim 8 wherein the container body comprises a circumferential groove and the cap assembly comprises a circumferential ridge, the circumferential groove receiving the circumferential ridge when the cap assembly is rotatably fastened to the container assembly, the circumferential groove and ridge being cooperable for enabling a user to rotate the cap assembly relative to the container assembly.

14. The multi-compartment container-cap assembly of claim 8 wherein the inner container walls are radially spaced from one another such that each matter-containing compartment is transversely sector shaped, a top surface of the divider assembly masking an adjacent portion of both a first and a last sector of the transversely sector shaped matter-containing compartments adjacent to the divider assembly for visually sizing and shaping the first and last sector to effectively match the size and shape of select other sectors.

15. A multi-compartment container-cap assembly, the multi-compartment container-cap assembly comprising:

a container assembly, the container assembly comprising a container body, and a divider assembly, the container body comprising an outer container wall, a series of inner container walls, and a container body axis, the series of inner container walls forming a series of matter-containing compartments within the container body, the divider assembly being received at an upper end of the container body and assembled thereto; and a cap assembly, the cap assembly comprising a contents-letting aperture, a cap axis, and indexing information provision means for providing a user with indexing information regarding rotational use of the cap assembly relative to the container assembly, the indexing information provision means comprise an indexing wheel and an indexing window, the indexing wheel being made selectively rotatable under rotatable action of the cap assembly relative to the container assembly for providing updated indexing information to a user via the indexing window, the indexing wheel and the divider assembly comprising cooperable gearing, the cap assembly being rotatably fastened to the container assembly such that the container body and cap axes are coaxial, the contents-letting aperture being blocked by the divider assembly in a closed cap-to-container rotatable position, the cap assembly being selectively rotatable about the cap axis for re-positioning the contents-letting aperture in superior adjacency to the matter-containing compartments through a series of open cap-to-container rotatable positions, the cooperable gearing for advancing the indexing wheel a select rotational degree during a complete rotational cycle of the cap assembly relative to the container assembly.

16. The multi-compartment container-cap assembly of claim 15 comprising button-based cap-advancing means, the button-based cap-advancing means for enhancing selectively positioned placement of the contents-letting aperture in superior adjacency to the matter-containing compartments.

17. A multi-compartment container-cap assembly, the multi-compartment container-cap assembly comprising:

a container assembly, the container assembly comprising a container body, and a divider assembly, the container body comprising an outer container wall, a series of inner container walls, and a container body axis, the series of inner container walls forming a series of matter-containing compartments within the container body, the divider assembly being received at an upper end of the container body and assembled thereto, the inner container walls being spaced from one another such that each matter-containing compartment is transversely sector shaped, a top surface of the divider assembly masking an adjacent portion of both a first and a last sector of the transversely sector shaped matter-containing compartments adjacent to the divider assembly for visually sizing and shaping the first and last sector to effectively match the size and shape of select other sectors; and a cap assembly, the cap assembly comprising a contents-letting aperture and a cap axis, the cap assembly being rotatably fastened to the container assembly such that the container body and cap axes are coaxial, the contents-letting aperture being blocked by the divider assembly in a closed cap-to-container rotatable position, the cap assembly being selectively rotatable about the cap axis for re-positioning the contents-letting aperture in superior adjacency to the matter-containing compartments through a series of open cap-to-container rotatable positions.

18. The multi-compartment container-cap assembly of claim 17 comprising button-based cap-advancing means, the button-based cap-advancing means for enhancing selectively positioned placement of the contents-letting aperture in superior adjacency to the matter-containing compartments.

* * * * *